United States Patent [19]

Kurosaki

[11] Patent Number: 4,928,567

[45] Date of Patent: May 29, 1990

[54] CLUTCH UNIT FOR HIGH-HAT CYMBALS

[75] Inventor: Makoto Kurosaki, Hamamatsu, Japan

[73] Assignee: Yamaha Corporation, Japan

[21] Appl. No.: 375,890

[22] Filed: Jul. 6, 1989

[30] Foreign Application Priority Data

Jul. 14, 1988 [JP] Japan ..... 63-93130[U]

[51] Int. Cl.[5] ..... G10G 5/00

[52] U.S. Cl. ..... 84/422.3; 84/421

[58] Field of Search ..... 84/402 A, 421, 422.3

[56] References Cited

U.S. PATENT DOCUMENTS

| | | | |
|---|---|---|---|
| 4,381,690 | 5/1983 | Kimble | 84/422.3 |
| 4,458,574 | 7/1984 | Hoshino | 84/422.3 |
| 4,528,888 | 7/1985 | Hoshino | 84/421 |

FOREIGN PATENT DOCUMENTS

| | | | |
|---|---|---|---|
| 3000536 | 7/1981 | Fed. Rep. of Germany | 84/422.3 |
| 590709 | 7/1947 | United Kingdom | 84/422.3 |

*Primary Examiner*—Lawrence R. Franklin

*Attorney, Agent, or Firm*—Lerner, David, Littenberg, Krumholz & Mentlik

[57] ABSTRACT

In construction of a clutch unit for a high-hat cymbal in which mechanical connection of an upper cymbal plate to an extension rod is canceled by striking a clutch lever by a stick, the clutch lever is arranged in a substantially horizontal disposition. Cancellation of the mechanical connection can be effected by vertically striking the clutch lever as in the case of normal performance of the cymbal.

1 Claim, 2 Drawing Sheets

CLUTCH UNIT FOR HIGH-HAT CYMBALS

BACKGROUND OF THE INVENTION

The present invention relates to an improved clutch unit for high-hat cymbals, and more particularly relates to an improvement in construction of a clutch unit used for operating an upper cymbal plate to assure easier performance.

In general, a high-hat cymbal includes a pair of cooperating cymbals, i.e. upper and lower cymbal plates. The lower cymbal is secured atop an upright tubular post supported by a tripod and the upper cymbal plate is coupled via a clutch unit to the top part of an extension rod running idly through the tubular post. The extension rod is always urged to move upwards by a proper elastic urging means such as a spring and is accompanied at its lower end with a foot pedal which effects up-and-down movement of the extension rod.

The clutch unit is attached to the top part of the extension rod in order to cause engagement and disengagement of the upper cymbal plate and the extension rod. More specifically, the clutch unit includes a holder inserted over the top part of the extension rod and secured thereto by means of a fastener nut. On the side opposite to the fastener nut, a clutch lever is pivoted to the holder via a horizontal pin and extends substantially vertically. The clutch lever is provided at its lower end with a hook. A spring is attached to the holder to urge the hook of the clutch lever to move towards the extension rod.

At a position below the holder, a clutch bolt is idly inserted over the extension rod. This clutch bolt is made up of an uppermost conical head, an intermediate cylindrical body and a lowermost threaded part delimited from the intermediate cylindrical body by a step. The hook of the clutch lever is usually kept in engagement with the step on the clutch bolt. A clutch nut is screwed over the lower part of the clutch bolt and a pair of cushions and inserted over the clutch bolt sandwiching the upper cymbal plate above the clutch nut. A pair of lock nuts are screwed over the lowermost threaded part of the clutch bolt to keep the cushions in pressure contact with the upper cymbal plate.

When a stick is swung horizontally to strike the top part of the clutch lever towards the extension rod, the clutch lever swings on the holder to disengage its lower end hook from the step on the clutch bolt which thereupon falls to cause percussive contact of the upper cymbal plate with the lower cymbal plate.

After striking by the stick, the clutch lever tends to resume its usual position due to a force by the spring and the bottom hook rides on the conical head of the clutch bolt. For separation of the cymbal plates, the pedal is stepped by the player and the extension rod is forced to move downwards with the holder secured thereto. The bottom hook of the clutch lever slides down on the conical head of the clutch bolt and finally come into engagement with the step on the clutch bolt. As the step on the pedal is then removed, the extension rod automatically moves upwards due to the spring force and, via the resumed engagement, the clutch lever moves the upper cymbal plate out of contact with the lower cymbal plate. Briefly horizontal striking of the clutch lever by the stick causes the percussive contact of the cymbal plates whereas step on the pedal causes separation of the cymbal plates.

In the above-described procedure, it is necessary to strike the clutch lever by swinging the stick horizontally to mechanically disconnect the upper cymbal plate from the extension rod. This swing direction of the stick is quite different from those during normal performance. Such a dual mode of swing action often tends to smooth performance of the high-hat cymbal.

SUMMARY OF THE INVENTION

It is the object of the invention to enable troublefree disconnection of the upper cymbal from the extension rod without any ill influence on swing action of the stick during normal performance. In accordance with the present invention, a clutch lever in a clutch unit is designed to extend substantially in a horizontal direction.

DESCRIPTION OF THE PREFERRED EMBODIMENT

Figure 1:
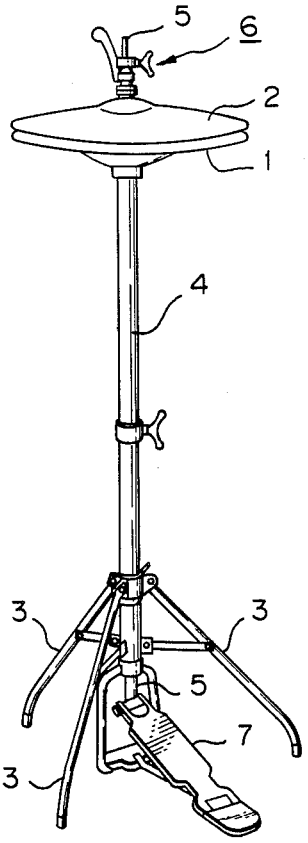
FIG. 1 is a perspective view of one example of the high-hat cymbal for which the clutch unit of the present invnetion is advantageously used.

FIG. 1 depicts one typical example of the high-hat cymbal for which the clutch unit in accordacne with the present invention is advantageous used. The cymbal includes cooperating upper and lower cymbal plates 2 and 1. The lower cymbal plate 1 is secured to the top of an upright tubular post 4 supported on the floor by a tripod 3 and the upper cymbal plate 2 is a clutch unit 6 of the present invention to the top part of an extension rod 5 running idly through the tubular post 4. The extension rod 5 is always urged to move upwards by a proper spring not shown and accompanied at its lower end with a foot pedal 7.

Figure 2:
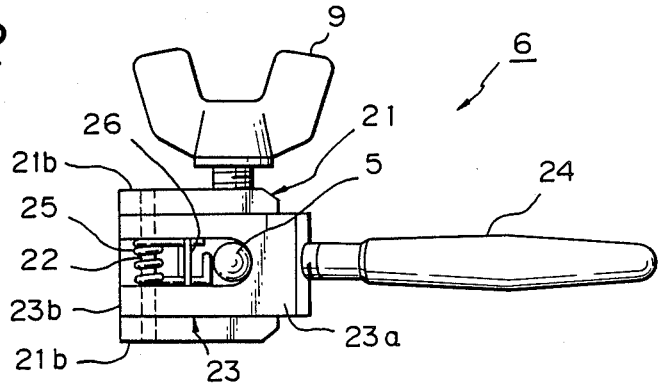
FIG. 2 is a top plan view of one embodiment of the clutch unit in accordance with the present invention.
Figure 3:
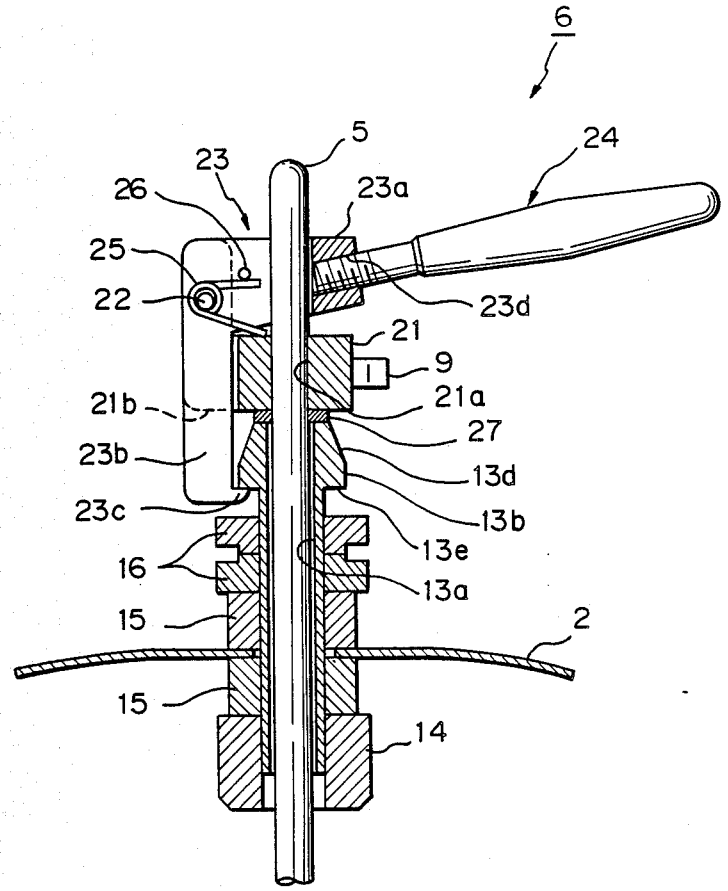
FIG. 3 is a side view, partly in section, of the clutch unit shown in FIG. 2.

As shown in FIGS. 2 and 3, the clutch unit 6 includes a holder 21 having a rectangular solid configuration. A through hole 21*a* is formed vertically in the holder 21 for insertion of the extension rod 5. The holder 21 is further provided with a pair of spaced parallel side walls 21*b* extending upwards to hold a horizontal transverse pin 22. A hook block 23 is pivoted to the transverse pin 22. The hook block 23 is made of a connecting section 23*a* and a pair of spaced parallel arms 23*b* extending downwards from the connecting section 23*a*. The descending arms 23*b* are in contact with respective side walls 21*b* of the holder 21 and idly passed through by the transverse pin 22. The extension rod 5 extends through the gap between the two arms 23*b* of the hook block 23 in the vicinity of the connecting section 23*a*. A hook 23*c* is formed at the lower end of each arm 23*b*.

At a position below the holder 21, a clutch bolt 13 is idly inserted over the extension rod 5. This clutch bolt 13 is made of an uppermost conical head 13*d*, an intermediate cylindrical body 13*b* and a lowermost threaded part 13*a* delimited from the cylindrical body 13*d* by a step 13*e*. A clutch nut 14 is screwed over the lower part of the clutch bolt 13 and a pair of cushions 15 are interted over the clutch bolt 13 sandwiching the upper cymbal plate 2 above the clutch nut 14. A pair of lock nuts 16 are screwed over the threaded part 13*a* of the clutch bolt 13 to keep the cushions 15 in pressure contact with the upper cymbal plate 2.

The hooks 23*c* of the descending arms 23*b* is normally kept in engagement with the step 13*e* on the clutch bolt 13. On the side opposite to the arms 23*b*, a thread hole 23*d* is formed horizontally in the connecting section 23*a* of the hook block 23 for screw engagement with a clutch lever 24.

Within the gap between the two arms 23*b*, a coil spring 25 is inserted over the transverse pin 22. One end of the coil spring 25 is in contact with the upper face of the holder 21 and the other end in engagement with a pin 26 held by the arms 23*b* of the hook block 23 at a position between the transverse pin 22 and the extension rod 5. A cushion 27 made of resin or the like is interposed between the holder 21 and the clutch bolt 13.

When the clutch lever 24 is struck by vertical swing of a stick, the clutch lever 24 swings about the transverse pin 22 against the force by the coil spring 25 together with the hook block 23 and, as a consequence, the hooks 23*c* and the descending arms 23*b* of the hook block 23 is released from engagement with the step 13*e* on the clutch bolt 13. As a result, the clutch bolt 13 slides downwards on the extension rod 5 to bring the upper cymbal plate 2 into percussive contact with the lower cymbal plate 1.

As the foot pedal 7 is stepped, the holder 21 and the hook block 23 move downward with the extension rod 5 and the hook 23*c* on the hook block 23 slides downwards on the conical head 13*d* of the clutch bolt 13 for final engagement with the step 13*e* on the clutch bolt 13. As the step on the foot pedal 7 is removed, the extension rod 5 automatically move upwards due to spring repulsion and the upper cymbal plate 2, which is now mechanically connected to the extension rod 5 via the clutch unit 6, is brought out of contact with the lower cymbal plate 1.

In accordance with the present invention, the mechanical connection between the upper cymbal plate and the extension rod can be reliably canceled mere by vertical swing of the stick without any ill influence on normal swing action of the stick during normal performance.

I claim:

1. A clutch unit for a high-hat cymbal, in which a lower cymbal plate is mounted atop a vertical post, an extension rod is idly inserted through said post and normally elastically urged to move upwards and an upper cymbal plate is mechanically connected to said extension rod via said clutch unit for selective percussive contact with said lower cymbal plate, comprising a clutch bolt idly inserted over said extension rod in fixed connection to said upper cymbal plate and provided with a depression, a holder secured to said extension rod above said clutch bolt, a hook block pivoted to said holder, and provided with at least one hook engageable with said depression in said clutch bolt and a clutch lever substantially horizontally fixed thereto, and means for elastically holding said hooking in engagement with said depression.

* * * * *